US006297745B1

(12) United States Patent
Meier

(10) Patent No.: US 6,297,745 B1
(45) Date of Patent: Oct. 2, 2001

(54) HOUSING FOR AN ALARM

(75) Inventor: Marco Meier, Oetwil am See (CH)

(73) Assignee: Siemens Buildings Technologies AG, Mannedorf (CH)

( * ) Notice: Subject to any disclaimer, the term of this patent is extended or adjusted under 35 U.S.C. 154(b) by 0 days.

(21) Appl. No.: 09/511,836

(22) Filed: Feb. 24, 2000

(30) Foreign Application Priority Data

Mar. 8, 1999 (EP) ..... 99104593

(51) Int. Cl.[7] ..... G08B 23/00

(52) U.S. Cl. ..... 340/693.11; 340/568.1; 340/571; 340/500; 340/693

(58) Field of Search ..... 340/693.11, 568.1, 340/571, 500, 427, 542, 568, 547, 693

(56) References Cited

U.S. PATENT DOCUMENTS

| | | | | |
|---|---|---|---|---|
| 4,359,646 | * | 11/1982 | Mejia et al. | 340/693 |
| 4,410,884 | * | 10/1983 | Heiland | 340/545 |
| 4,418,336 | * | 11/1983 | Taylor | 340/571 |
| 4,710,629 | | 12/1987 | Muller et al. . | |
| 4,752,768 | | 6/1988 | Steers et al. . | |
| 4,880,980 | | 11/1989 | Muller et al. . | |
| 5,191,314 | * | 3/1993 | Ackerman et al. | 340/542 |
| 5,194,845 | * | 3/1993 | Sirmon et al. | 340/427 |
| 5,942,976 | | 8/1999 | Wieser et al. . | |

FOREIGN PATENT DOCUMENTS

| | | |
|---|---|---|
| 0476397 | 3/1992 | (EP) . |
| 0499177 | 8/1992 | (EP) . |
| 0786751 | 7/1997 | (EP) . |
| 0834847 | 4/1998 | (EP) . |

OTHER PUBLICATIONS

Catalog Sheet of Alarmcom for "Professional Passive Infrared Detector With Exceptional RF Immunity", IR160B, Catalog: 1; Section: 2 (1999).

Catalog Sheet of Alarmcom for "Black Mirror", IR160, (1996).

European Search Report for 99104593 dated Aug. 30, 1999.

* cited by examiner

*Primary Examiner*—Jeffery Hofsass
*Assistant Examiner*—Daniel Previl
(74) *Attorney, Agent, or Firm*—BakerBotts LLP

(57) ABSTRACT

A housing for an alarm includes a base adapted for mounting on a wall, a cover detachably connectable to the base and a sabotage detector for triggering an alarm signal in the event of unauthorized removal of the cover or forcible removal of the alarm from the wall. The base includes a breakaway portion which can be formed as strip-shaped region bordered by weak points. A number of screw insertion points extend through the breakaway portion for fastening the breakaway portion to a wall with one or more screws. A web projects from the breakaway portion and towards the cover such that when the housing is closed, the web engages a contact switch mounted in the cover. In the event of the housing being ripped off the wall, the strip-shaped region is broken off the base and remains on the wall, thereby opening the contact switch. The web is also disengaged from the contact switch in the event of unauthorized removal of the cover from the base.

18 Claims, 1 Drawing Sheet

HOUSING FOR AN ALARM

FIELD OF THE INVENTION

The present invention relates to a housing for an alarm, and more particularly relates to a housing for an alarm having a sabotage detector for triggering an alarm signal in the event of cover removal or forcible removal of the alann from the wall.

BACKGROUND

Modem alarm systems are known for high reliability. As a result, such systems, in particular burglar alarm systems, are often subjected to sabotage attempts which range from covering the alarm to ripping the alarm off the wall. Covering or masking of the alarm, which is a method of attacking alarm sensors such as passive infrared alarms, include covering the alarm with a box, hat or other suitable screen or by spraying the entry window of the alarm for the infrared radiation with an infrared-opaque medium. As a countermeasure for this attack mode, an additional detection system is generally incorporated into the detector, such as those which are described, for example, in EP-A-0 186 226, EP-A-0 189 536, EP-A-0 476 397, EP-A-0 499 177 or EP-A-0 772 171 (U.S. Pat. No. 5,942,976).

Another type of sabotage consists of disabling the burglar alarm by unauthorized opening of the cover. A cover contact which is opened upon removal of the cover is often used to detect such sabotage. It is also possible to couple the cover contact to the locking device between base and cover so that operation of the locking device itself is detected (see, in this regard, EP-A-0 616 307).

Yet another form of attack on an alarm system includes physically removing the alarm sensor from the wall on which it is mounted. A system for detecting this type if attached is implemented in at least one known burglar alarm system (type IR160 of Alarmcom AG, CH-8604 Volketswil). This particular detection scheme uses a panel, which is penetrated by a fastening screw of the alarm and is relatively easy to break off the base, and a contact switch. The switch is fixed on a part of the base which is not intended to be broken off and has an actuator portion that presses against a projection of the panel which is intended to be broken off. In the event of the alarm being ripped off the wall, the panel which may be broken off the base remains on the wall and the contact switch is removed from engagement with the panel, thereby opening the electrical contact of the switch. Since the alarm components, particularly passive infrared sensors, are generally intended both for flat wall mounting and for corner mounting, at least two break-off panels must be provided with associated contact switches mounted adjacent to the panels.

Although this known solution has been successful, it requires extra assembly effort and entails additional cost as a result of requiring two contact switches. Accordingly, an improved arrangement for detecting an attack on the mounting of alarm components is required.

OBJECTS AND SUMMARY OF THE INVENTION

An object of the present alarm housing is to trigger an alarm signal in the event of forcible removal of the alarm from the wall in a manner which is low cost and easy to install.

A further object of the present alarm housing is to provide an alarm signal in the event of either forcible removal of the alarm from the wall or unauthorized removal of the alarm housing cover.

In accordance with a first embodiment, the alarm housing includes a base and a cover. The base includes a breakaway portion, such as strip-shaped region which is bordered by weak points. The breakaway region has a plurality of screw insertion points for receiving fastening screws there through. A web is included which has a fixed end on the breakaway portion and a free end that projects towards the cover. When the housing is closed, the free end of the web contacts an actuating portion of a contact switch mounted in the cover, thereby activating the switch (e.g., closing the contacts).

In the event that the alarm housing is forcibly removed from the wall, the entire strip-shaped region is broken off the base, removing the web from contact with the switch. As a result, the contact switch for the various types of fastening need be disposed at a single point only. The forward-projecting web and the associated contact switch in the cover achieve the advantage that both opening of the cover and ripping of the alarm off the wall may be detected by a single contact switch. Thus, costs arc reduced by dispensing with one contact switch. In addition, assembly of the alarm is considerably simplified because the contact switch can be pre-installed in the alarm electronics assembly and need no longer be inserted into the alarm on site. This also eliminates any risk of the contact switch being inserted into the alarm incorrectly.

In a preferred embodiment of the housing, the strip-shaped region extends transversely over the base and has screw insertion points for various types of fastening of the alarm, such as wall mounting and corner mounting.

In another preferred embodiment of the housing, the cover includes a printed-circuit board bearing the detection electronics and the contact switch is disposed on the printed-circuit board.

Figure 3:
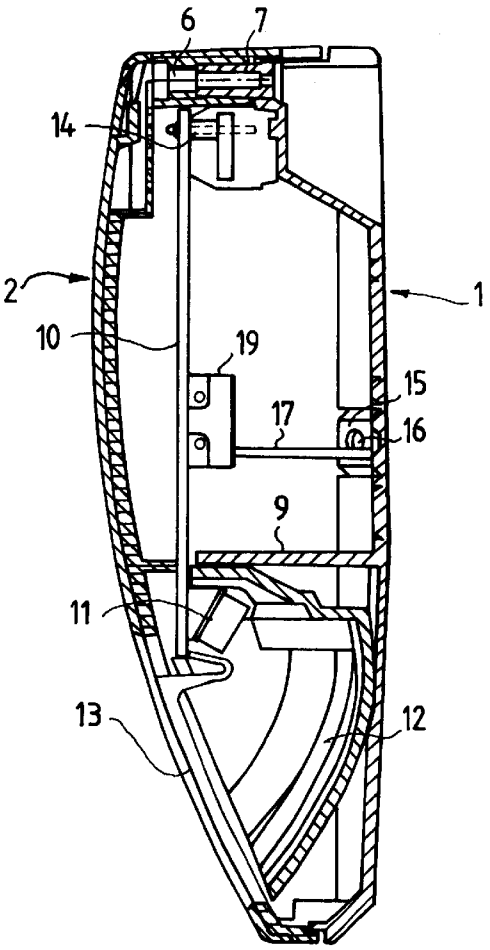
FIG. 3 is a section through a complete housing along the line III—III of FIG. 1.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF PREFERRED EMBODIMENTS

The present housing for an alarm, which is particularly well suited for housing a passive infrared alarm, includes a base 1 and a cover 2 detachably connectable to the base. The connection between the base 1 and the cover 2 preferably includes a detent connection fixable by a screw. To achieve this attachment, the base 1 has at its bottom transverse edge two slots 4 which are disposed in projections 3 and are intended to receive corresponding lugs (not shown) disposed on the bottom transverse edge of the cover 2.

To close the housing, the cover 2 is engaged on the base 1 with the lugs into the slots 4 with the cover is aligned at an angle of around 30° away with the base 1. The cover 2 is engaged on the base 1 and is then folded towards the base until resilient hooks 5 disposed in the region of the top transverse edge of the base 1 snap into corresponding counterparts of the cover 2. The cover 2 can then be more permanently fixed in the closed position by the inclusion of a screw 6 against a lug 7 situated between the hooks 5. Preferably, the head of the screw 6 is masked in the cover 2 by a flap so that the screw 6 is not detectable by an observer without closer examination of the alarm. Of course, it will be appreciated that numerous other connecting fastener arrangements can be used to connect the base 1 and cover 2.

The base 1 at its top end, e.g., above transverse web 9 and just below the hooks 5, includes a jack element 8 of an electrical connector. A printed-circuit board 10 is preferably mounted in the cover 2 and carries the detection electronics of the alarm, such as an infrared sensor 11. The cover 2 will also generally support an infrared-transmitting window 13 which allows infrared radiation to pass through the cover 2 onto an infrared reflector 12, which focuses the incident radiation onto the infrared sensor 11. These elements of a passive infrared detector assembly are generally known, as exemplified by U.S. Pat. No. 4,880,980.

Disposed at the top end of the printed-circuit board 10, as a counterpart to the jack element 8, is a pin element 14 of the electrical connector, which during closure of the housing is inserted into the jack element 8, thereby making electrical contact with the power supply and any data lines and other connections to as alarm control panel (not shown). The power supply line and all other lines are run through holes in the base 1 up to the jack clement 8.

Figure 2:
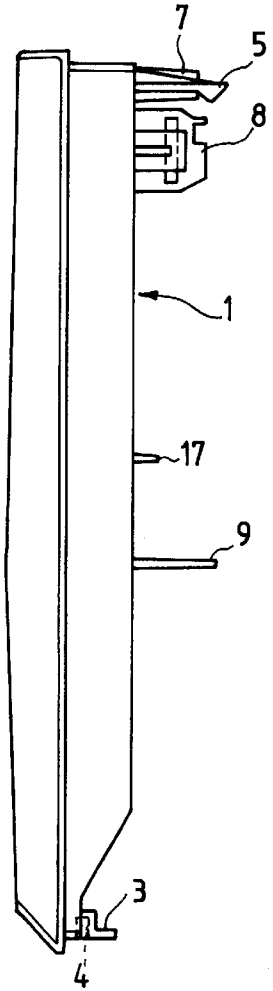
FIG. 2 is a view in the direction of the arrow II of FIG. 1.
Figure 1:
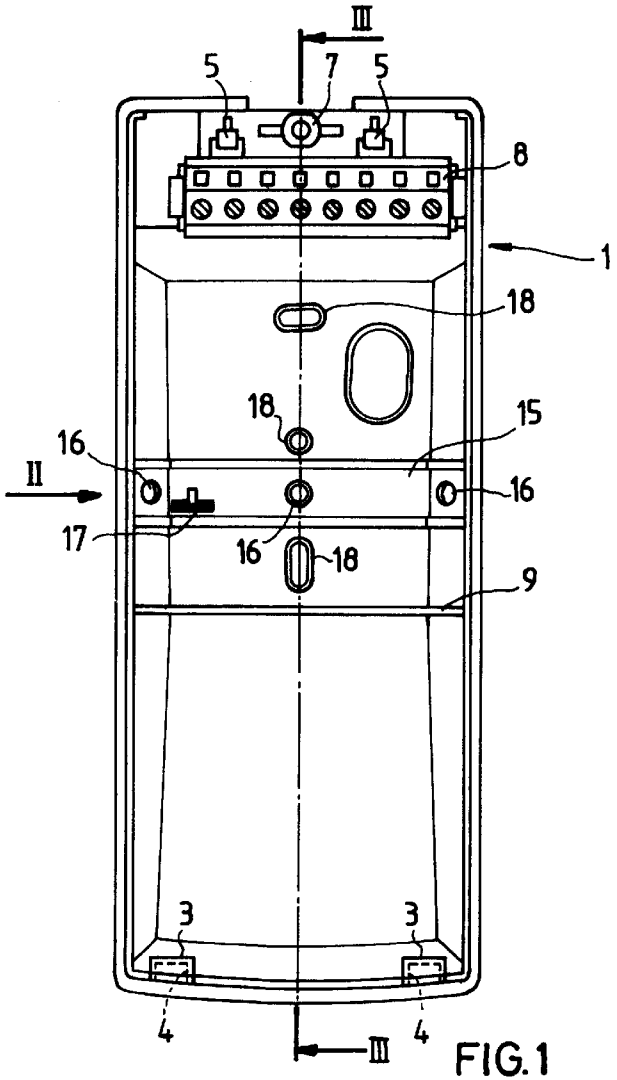
FIG. 1 is a front view of the base of a housing according to the invention.

Referring to FIG. 1, the base 1 includes a breakaway portion formed by a transverse strip 15 bordered by weak points (rupture joints) and has a number of (e.g., three) screw insertion points 16 for receiving fastening screws. A web 17, which projects in the direction of the cover 2 extends from the transverse strip 15 (in this regard see also FIGS. 2 and 3). The base 1 at each of its longitudinal edges has a bevel sloping at an angle of about 45° to facilitate corner mounting of the housing. In a corresponding manner, the ends of the transverse strip 15 slope forward at an angle of about 45° relative to its central part. Both the central part and the two ends of the transverse strip 15 have a screw insertion point 16. The screw insertion point 16 of the central part of the transverse strip 15 is generally used for flat wall mounting and the screw insertion points 16 of the ends of the transverse strip 15 are generally used for corner mounting.

The main fastening load of the alarm to the wall is generally effected by screws which extend through mounting holes 18 in the base 1 which are located outside the transverse strip 15. The screws extending through the screw insertion points 16 are used, not for fastening of the entire alarm housing, but primarily for fixing the transverse strip 15 to the wall.

A contact switch 19 is preferably mounted on the printed-circuit board 10 on the side of the printed circuit board 10 which is directed towards the base 1. The contact switch 19 includes an actuator portion which projects towards the base 1. The contact switch 19 is disposed on the printed-circuit board 10 in such a way that it lies immediately in front of the free end of the web 17. The web 17 is so dimensioned that it engages the actuating portion of the switch 19 when the housing is closed. If the contacts of switch 19 are opened for any reason, the detection electronics produce a sabotage signal, which indicates that the alarm may be disabled.

There are two principal reasons why the contact at the switch 19 will open. The first reason is the unauthorized removal of the cover 2 from the base 1, with the result that the alarm would no longer be able to function owing to opening of the electrical connector 8, 14. As the cover 2 is removed, the sabotage detector formed by the web 17 and the contact switch 19 acts as a cover contact and detects this event.

The second reason for the switch 19 opening is the forcible removal of the alarm off the wall. In this case, the transverse strip 15 fastened to the wall breaks off the base 1 and remains together with the web 17 on the wall. As a result, the free end of the web 17 no longer remains in contact with the actuating portion of the switch 19 and the contact of the switch 19 is opened. Thus, the same sabotage detector which detected contact removal also detects the forcible removal of the housing from the wall.

Although the present invention has been described in connection with specific exemplary embodiments, it should be understood that various changes, substitutions and alterations can be made to the disclosed embodiments without departing from the spirit and scope of the invention as set forth in the appended claims.

What is claimed is:

1. In a housing for an alarm, having a base intended for fastening to a wall and a cover detachably connectable to the base, the improvement comprising:

a breakaway region formed in the base and having a plurality of screw insertion points extending there through for receiving a fastening screw to the wall;

a contact switch mounted in the cover and having an actuator portion; and a web projecting from the breakaway region and having a free end disposed towards the cover, the web being sized such that when the housing is closed, said free end operatively engages the actuator portion of the contact switch.

2. The housing according to claim 1, wherein the breakaway region is a strip-shaped region.

3. The housing according to claim 2, wherein the strip-shaped region extends transversely across the base and comprises screw insertion points at a plurality of locations to accommodate one of flat wall mounting and corner mounting of the housing.

4. The wall mountable housing according to claim 3, wherein the strip-shaped region includes a central portion to accommodate flat wall mounting and two angularly extending end portions to accommodate corner mounting of the housing.

5. The wall mountable housing according to claim 4, wherein the plurality of screw insertion points include at least one screw insertion point in each of the central portion and end portions of the strip-shaped region.

6. The housing according to claim 3, further comprising a printed-circuit board carrying detection electronics mounted within the cover, and wherein the contact switch is disposed on said printed-circuit board.

7. The housing according to claim 6, wherein said contact switch is operably coupled to the detection electronics an provides a condition indicative of sabotage of the housing in the event of one of unauthorized removal of the cover from the base and forcible removal of the housing from the wall.

8. The housing according to claim 7, wherein the cover is fixed to the base by a screw, and wherein the cover further comprises a flap for covering said screw.

9. The housing according to claim 1, wherein the cover is fixed to the base by a screw, and wherein the cover further comprises a flap for covering said screw.

10. A wall mountable housing for an alarm component comprising:

a housing base, the housing base having a breakaway region formed therein with at least one screw insertion point extending through the breakaway region for receiving a fastening screw to the wall;

a cover assembly detachably connectable to the base;

a contact switch mounted in the cover assembly and having an actuator portion; and a web projecting from the breakaway region of the base and having a free end disposed towards the cover assembly, the web being sized such that when the cover assembly is engaged on the base, said free end of the web operatively engages the actuator portion of the contact switch.

11. The wall mountable housing according to claim 10, wherein the breakaway region is a strip-shaped region.

12. The wall mountable housing according to claim 11, wherein the strip-shaped region extends transversely across the base and comprises screw insertion points at a plurality of locations to accommodate one of flat wall mounting and corner mounting of the housing.

13. The wall mountable housing according to claim 12, wherein the strip-shaped region includes a central portion to accommodate flat wall mounting and two angularly extending end portions to accommodate corner mounting of the housing.

14. The wall mountable housing according to claim 13, wherein the plurality of screw insertion points include at least one screw insertion point in each of the central portion and end portions of the strip-shaped region.

15. The housing according to claim 11, wherein the cover assembly includes a printed-circuit board carrying detection electronics, and wherein the contact switch is disposed on the printed-circuit board.

16. The housing according to claim 15, wherein said contact switch is operatively coupled to the detection electronics and provides a condition indicative of sabotage of the housing in the event of one of unauthorized removal of the cover from the base and forcible removal of the housing from the wall.

17. The housing according to 16, wherein the cover assembly is fixed to the base by a screw, and wherein the cover further comprises a flap for covering said screw.

18. The housing according to 11, wherein the cover is fixed to the base by a screw, and wherein the cover further comprises a flap for covering said screw.

* * * * *